US009505007B2

(12) United States Patent
Harthoorn et al.

(10) Patent No.: US 9,505,007 B2
(45) Date of Patent: Nov. 29, 2016

(54) DEFLECTION STRUCTURE FOR TUB GRINDER

(71) Applicant: Vermeer Manufacturing Company, Pella, IA (US)

(72) Inventors: Duane Allen Harthoorn, Lynnville, IA (US); Greg Williams, Pella, IA (US); Jerry Patterson, Prairie City, IA (US)

(73) Assignee: Vermeer Manufacturing Company, Pella, IA (US)

( * ) Notice: Subject to any disclaimer, the term of this patent is extended or adjusted under 35 U.S.C. 154(b) by 425 days.

(21) Appl. No.: 13/748,401

(22) Filed: Jan. 23, 2013

(65) Prior Publication Data

US 2013/0200189 A1 Aug. 8, 2013

Related U.S. Application Data

(60) Provisional application No. 61/593,622, filed on Feb. 1, 2012.

(51) Int. Cl.

| | |
|---|---|
| ***B02C 13/286*** | (2006.01) |
| ***B02C 13/13*** | (2006.01) |
| ***B02C 18/06*** | (2006.01) |
| ***B02C 18/22*** | (2006.01) |

(52) U.S. Cl.

CPC ..... *B02C 13/286* (2013.01); *B02C 13/13* (2013.01); *B02C 18/067* (2013.01); *B02C 18/2225* (2013.01)

(58) Field of Classification Search

CPC ..... B02C 13/286; B02C 18/2225; B02C 18/067; B02C 13/13

USPC ..... 241/186.35, 186.4, 73, 186.2, 186.3, 241/189.1, 101.761

See application file for complete search history.

(56) References Cited

U.S. PATENT DOCUMENTS

| | | | | | |
|---|---|---|---|---|---|
| 3,915,397 | A | * | 10/1975 | Olson | 241/189.2 |
| 3,966,128 | A | * | 6/1976 | Anderson | A01F 29/005 241/101.761 |
| 4,033,515 | A | * | 7/1977 | Barcell et al. | 241/27 |
| 4,585,180 | A | | 4/1986 | Potts | |
| 4,997,135 | A | * | 3/1991 | Zehr | B02C 18/067 241/101.761 |
| 5,207,391 | A | * | 5/1993 | Anderson | 241/186.4 |
| 5,507,441 | A | | 4/1996 | De Boef et al. | |
| 5,570,849 | A | * | 11/1996 | Anderson | 241/186.4 |
| 5,803,380 | A | | 9/1998 | Brand et al. | |
| 5,950,942 | A | | 9/1999 | Brand et al. | |
| 6,412,715 | B1 | | 7/2002 | Brand et al. | |
| 6,422,495 | B1 | | 7/2002 | De Boef et al. | |
| 6,745,965 | B1 | * | 6/2004 | Onoda | B02C 18/067 241/101.761 |
| 6,840,471 | B2 | | 1/2005 | Roozeboom et al. | |
| 6,843,435 | B2 | | 1/2005 | Verhoef et al. | |
| 6,978,955 | B2 | | 12/2005 | Verhoef et al. | |

(Continued)

*Primary Examiner* — Mark Rosenbaum

(74) *Attorney, Agent, or Firm* — Merchant & Gould P.C.

(57) ABSTRACT

A tub grinder includes a rotatable tub positioned above a floor; a grinder that has cutters defining a circular reducing boundary when the grinder is rotated in a reducing direction; and a deflection structure positioned near the floor above the grinder. The deflection structure includes first and second deflecting portions. The second deflection structure is oriented closer to horizontal than the first deflection structure. At least part of the second deflecting portion is located below a top, dead center of the reducing boundary of the grinder. The deflecting structure limits the trajectory of material ejected from the grinder to a departure angle of about 25 degrees.

31 Claims, 4 Drawing Sheets

(56) References Cited

U.S. PATENT DOCUMENTS

| | | | |
|---|---|---|---|
| 7,077,345 | B2 | 7/2006 | Byram et al. |
| 7,213,779 | B2 | 5/2007 | Roozeboom et al. |
| 7,441,719 | B2 | 10/2008 | Verhoef et al. |
| 7,461,802 | B2 | 12/2008 | Smidt et al. |
| 7,896,274 | B2 | 3/2011 | Roozeboom |
| 7,959,097 | B2 | 6/2011 | De Boef |
| 7,971,818 | B2 | 7/2011 | Smidt et al. |
| 8,104,701 | B2 | 1/2012 | Smidt et al. |
| 8,245,961 | B2 | 8/2012 | Vroom et al. |
| 8,567,706 | B2 | 10/2013 | Bradley et al. |
| 8,602,333 | B2 | 12/2013 | Bradley et al. |
| 2008/0135656 | A1* | 6/2008 | Bradley ..... B02C 23/18 241/101.6 |

* cited by examiner

DEFLECTION STRUCTURE FOR TUB GRINDER

CROSS-REFERENCE TO RELATED APPLICATION

The present application claims the benefit of U.S. Provisional Patent Application Ser. No. 61/593,622, filed Feb. 1, 2012, which application is hereby incorporated by reference in its entirety.

TECHNICAL FIELD

This invention pertains to tub grinders for grinding waste material. More particularly, this invention pertains to a cover and other elements for reducing debris ejection out of the tub grinder during operation.

BACKGROUND

Tub grinders are intended for use in grinding organic waste material (e.g., brush, wood, grass, leaves, paper, etc.). Conventional tub grinders include a rotary grinding member which is mounted on a frame for rotation about a horizontal axis. A rotating tub surrounds the grinding member. The tub rotates about a general vertical axis. Debris is deposited in the rotating tub and the rotary grinding member grinds the debris.

The rotary tub grinder may eject material from the tub resulting in projectiles being thrown from the tub during its use. Tub grinders are powerful machines. Commonly, a tub grinder may be powered by a 400 horsepower motor with the grinder rotating at about 2100 rpm. Occasionally, through misuse of the tub grinder or the like, metal or other undesired material may be admitted to the tub grinder.

Some conventional tub grinders include hoods to deflect material downwardly. Such hoods are positioned directly above the grinding member and have been used to limit the amount of material which may be deflected by the grinding member. However, even with such hoods, material may still be deflected out of the tub. Example hoods may be found in U.S. Pat. No. 4,585,180 (see item 34 in FIG. 4) and U.S. Pat. No. 6,412,715 (see item 50 in FIG. 6).

Notwithstanding the prior techniques for reducing deflection of material from a tub, additional improvements are desirable to reduce the amount of debris material being deflected for a tub grinder.

SUMMARY

Aspects of the disclosure relate to a tub grinder including a floor; a tub positioned above the floor; a grinder mounted at an opening in the floor; a screen positioned beneath the grinder; and a deflection structure positioned near the floor above the grinder.

The tub is rotatable relative to the floor about a vertical axis. The grinder has cutters that define a circular reducing boundary when the grinder is rotated in a reducing direction. The deflection structure includes first and second deflecting portions. The second deflection portion is oriented closer to horizontal than the first deflection portion. At least part of the second deflecting portion is located below a top, dead center of the reducing boundary of the grinder.

Other aspects of the disclosure relate to a comminuting apparatus including a bottom plate; a tub disposed at the bottom plate and being rotatable relative to the bottom plate; a comminuting drum that extends partially through the bottom plate; and a deflection structure that extends partially over the drum. The comminuting drum is configured to rotate about a horizontal axis of rotation and is configured to throw material in the tub along a material flow path. The deflection structure defines an exit aperture through which material is thrown by the comminuting drum during operation. The deflection structure includes a first planar member and a second planar member. The second planar member is oriented generally horizontal and the first planar member is angled relative to the second planar member.

Material within the tub that strikes the first plate slides along the first plate to the second plate at which the material changes direction and reduces speed.

Other aspects of the disclosure relate to a deflection plate for use with a rotary grinder having a circular reducing boundary within which the rotary grinder rotates to move material along a flow path. The deflection plate includes a first deflecting plate; a second deflecting plate; and a plurality of ribs extending between the first deflecting plate and the second deflecting plate. A planar surface of the second deflecting plate is oriented at an angle relative to the planar surface of the first deflecting plate. The angle ranges between about 90° and about 120°. Each rib has a first edge disposed at the first planar surface and a second edge disposed at the second planar surface. The ribs are spaced apart along a length of the deflecting plates.

A tub grinder includes a tub positioned above a floor; a rotatable reducing unit mounted at an opening in the floor; and a deflection structure positioned near the floor above the rotatable reducing unit. The rotatable reducing unit has outermost portions that define a circular reducing boundary when the rotatable recuing unit is rotated in a reducing direction.

The deflection structure includes first and second deflecting portions. The first deflecting portion is positioned upstream from the second deflecting portion. The first deflecting portion extends upwardly and angles away from the circular reducing boundary as the first deflecting portion extends toward the second deflecting portion in the reducing direction. The second deflecting portion extends away from the first portion in the reducing direction. The second deflecting portion angles towards the reducing boundary as the second deflection portion extends in the reducing direction.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

The present disclosure is directed towards apparatus for reducing undesired discharge of the waste material through the upper end of a tub grinder during operation. Such discharge may result in projectiles that can be thrown a substantial distance from the tub grinder at substantial velocities, representing a potential safety hazard.

Figure 1:
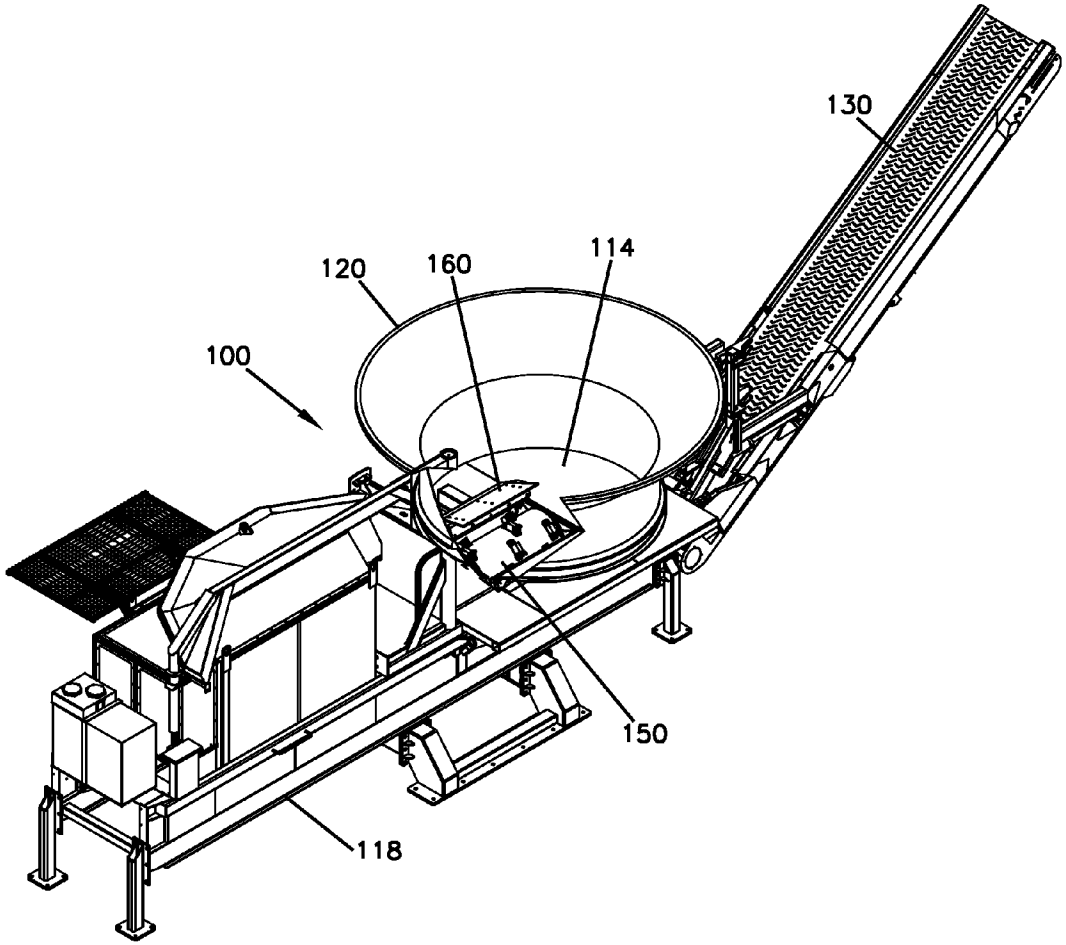
FIG. 1 is a top perspective view of an example tub grinder including a grinder and a deflection structure within a tub.

FIG. 1 illustrates an example tub grinder 100 including a rotary tub 120 mounted above a horizontal floor 114 for rotation about a vertical axis Z. The floor 114 and tub 120 are secured to a frame 118. In some implementations, the frame 118 includes a fastening member configured to enable the frame to be attached to a cab or other vehicle for towing the tub grinder 100 (e.g., as a trailer). In such implementations, wheels are mounted on the frame 118. In other implementations, the frame 118 is configured to be stationary.

A rotary grinder member 150 (e.g., a comminuting drum) is mounted within the frame 118. The grinding member 150 is coupled via a shaft 155 (FIG. 3) to an engine for rotating the grinding member 150. The grinder 150 includes a plurality of radially extending hammer members 152 that are configured to rotate about an axis X. In certain implementations, the axis X is generally orthogonal to the axis Z. In certain implementations, the axis X is generally parallel to the floor 114. In the example shown, the axis X is generally horizontal.

The rotation of the hammer members 152 defines a circular reducing boundary of the grinder 150. The grinder 150 also includes a screen 158 is mounted around the hammer members 152 at a position offset from the reducing boundary. The screen 158 extends partially around the grinder 150 and defines one or more exit apertures through which material falls during operation of the grinder 150.

Figure 2:
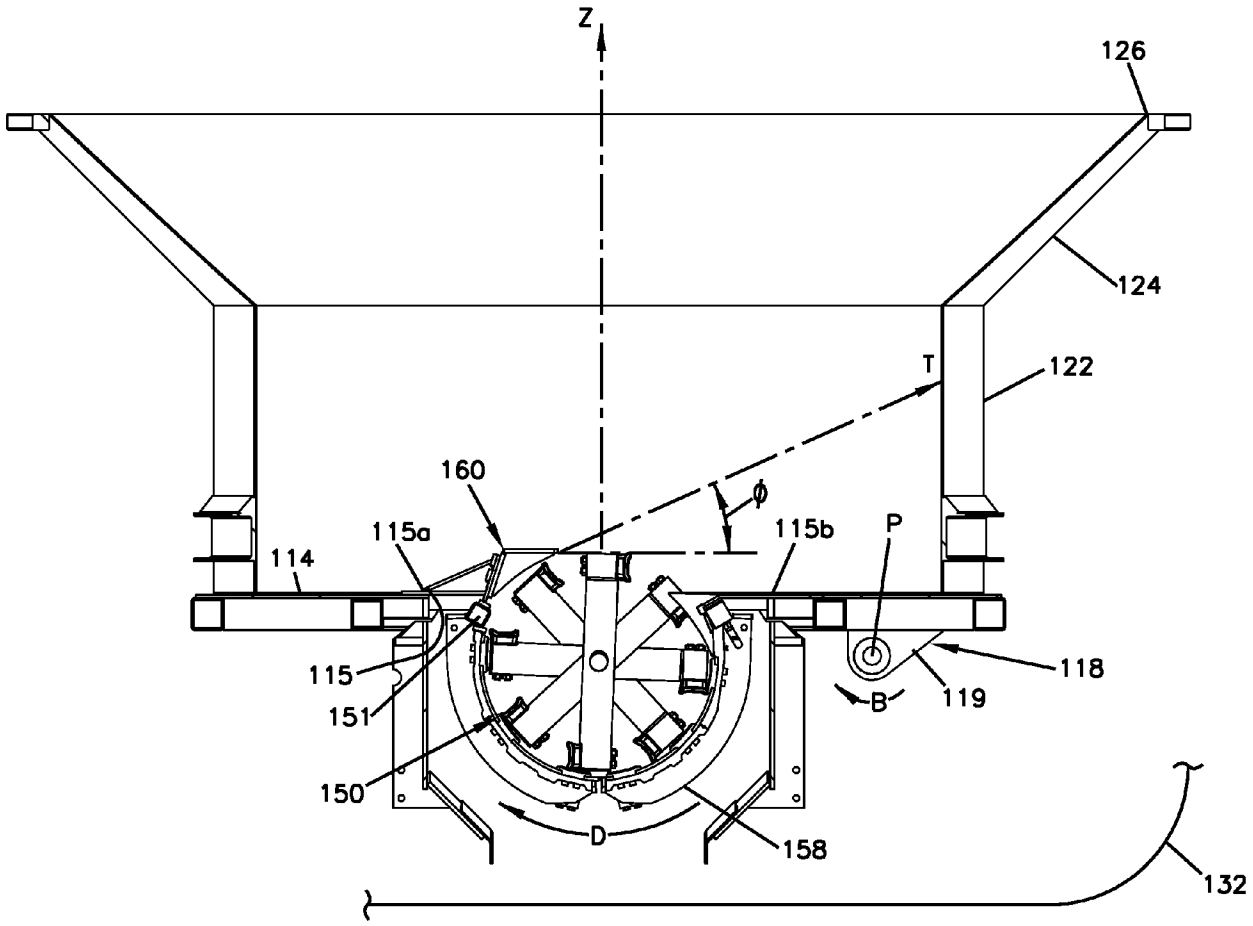
FIG. 2 is a cross-sectional view of the tub, grinder, and deflection structure shown in FIG. 1.

In the example shown in FIG. 2, the grinder 150 is mounted to the frame 118 so that a portion of the reducing boundary is exposed through an opening 115 defined in the floor 114. In other implementations, the grinder 150 may be mounted to the floor 114. In certain implementations, less than a majority of the grinder 150 extends into the tub 120. In certain implementations, less than half of the grinder 150 extends into the tub 120. In other implementations, a majority of the grinder 150 may be located within the tub 120.

Cutters 154 are mounted to distal ends of the hammer members 152. As the hammer members 152 are rotated about the axis X, each of the cutters 154 spins along a respective annular cutting path. The cutters 154 engage and crush waste material deposited in the tub 120 that enters the cutting paths. The tub 120 may be rotated concurrently with the hammer members 152 to bring the waste material into the cutting paths.

Waste material is deposited into the interior of the tub 120 by a crane or the like. The combined action of the rotation of tub 120 and rotation of the grinding member 150 causes the waste material to be broken down and deposited on a belt 132 carried on the frame 118 beneath the grinder member 150 as shown in FIG. 2. Waste material drops through a screen 158 onto the belt 132 from the grinder 150. The belt 132 carries the crushed and ground waste material away from the grinder 150 and deposits the waste onto a conveyor 130 (FIG. 1) for discharge.

With reference now to FIG. 2, a portion of the tub grinder 100 is shown in cross-section. The tub 120 rests on floor 114 and is rotatable about the vertical axis Z. The tub 120 includes a generally cylindrical wall 122 with a lower end of the wall 122 in close proximity to the floor 114 as the tub 120 rotates about the vertical axis Z. Secured to an upper end of the circumferential wall 122 is frusto-conical portion 124, which terminates at an upper tub opening 126. In commercially sized tub grinders 100, the cylindrical wall 122 may have a diameter of about 8 feet. The tub opening 126 typically has a diameter of about 12 feet. In a commercially sized tub grinder 100, the cylindrical wall 122 has a vertical height of about 3 feet and the frusto-conical portion 124 has a vertical height of about 2 feet.

Both the floor 114 and the tub 120 are connected to a pivot flange 119 such that both of the tub 120 and floor 114 may be pivoted about a pivot point P in the direction of arrow B in FIG. 2. The tub 120 and floor 114 may be pivoted by an angle of no more than about 90 degrees to permit discharge of waste material from the tub 120 and to allow access by workers into the interior of the tub 120 for cleaning purposes and the like.

The grinding member 150 rotates about the horizontal axis X in the direction of rotation indicated by arrow D. As the grinder 150 rotates about axis X, the hammer members 152 pass up a first side 115*a* of the floor opening 115 to a point above the floor 114 and then pass downwardly through a second side 115*b* of the opening 115. In the example shown in FIG. 2, the grinder 150 rotates clockwise. Accordingly, material being reduced by the grinder 150 is moved in a clockwise flow direction.

From time to time, waste material may be ejected from the tub 120 through opening 126. The ejection of such waste material particularly occurs in the event that unauthorized material (e.g., metal, glass) are admitted into the tub 120. It is not practical to cover the opening 126 throughout operation of the tub grinder 100 since access must be had through the opening 126 in order to place waste material into the tub 120.

In some implementations, the tub grinder 100 includes a tub cover that deflects material thrown by the grinder 150 back into the tub 120. The tub cover is positioned at the open top 126 of the tub. In certain implementations, the tub cover may include a first planar member and a second planar member. In certain implementations, the second planar member is oriented generally horizontal and the first planar member is angled relative to the second planar member. In other implementations, other types of tub covers may be positioned at the top 126 of the tub 120. In still other implementations, the top 126 of the tub 120 is left open.

Example tub covers may be found in U.S. Pat. No. 5,803,380, the disclosure of which is hereby incorporated herein by reference.

In some implementations, the deflection structure 160 is positioned near the floor 114 above a portion of the grinder 150. The deflection structure 160 is positioned outside the reducing boundary of the grinder 150. In some implementations, the deflection structure 160 extends over less than half of the reducing boundary of the grinder 150. In certain implementations, the deflection structure 160 extends over less than a quarter of the reducing boundary of the grinder 150. In certain implementations, the deflection structure 160 extends across less than half of a cross-dimension (e.g., a diameter) of the grinder 150.

The deflection plate 160 includes a first deflection portion 162 and a second deflection portion 164. Each of the deflection portions 162, 164 extends from a first end to a second end. The first end of the first deflection portion 162 couples to the grinder 150, the grinder screen 158, or the floor 114 of the tub 120. The second end of the first deflection portion 162 couples to or otherwise engages the first end of the second deflection portion 164.

The second end of the second deflection portion 164 is freely extended over the grinder 150. In the example shown, the first deflection portion 162 is formed by a first planar member and the second deflection portion 164 is formed by a second planar member. In other implementations, however, the first and second deflection portions 162, 164 can be formed by contoured members.

The second deflection portion 164 extends at an orientation that is closer to horizontal than an orientation of the first deflection portion 162. In some implementations, the first deflection plate 162 is oriented at an angle a relative to the second deflection plate 164. In certain implementations, the angle A ranges from about 80° to about 125°. In certain implementations, the angle A is greater than about 90° . In certain implementations, the angle A is greater than about 100°. In certain implementations, the angle A ranges from about 100° to about 110°. In other implementations, however, the deflection portions 162, 164 may be oriented relative to each other at a greater or lesser angle.

Figure 4:
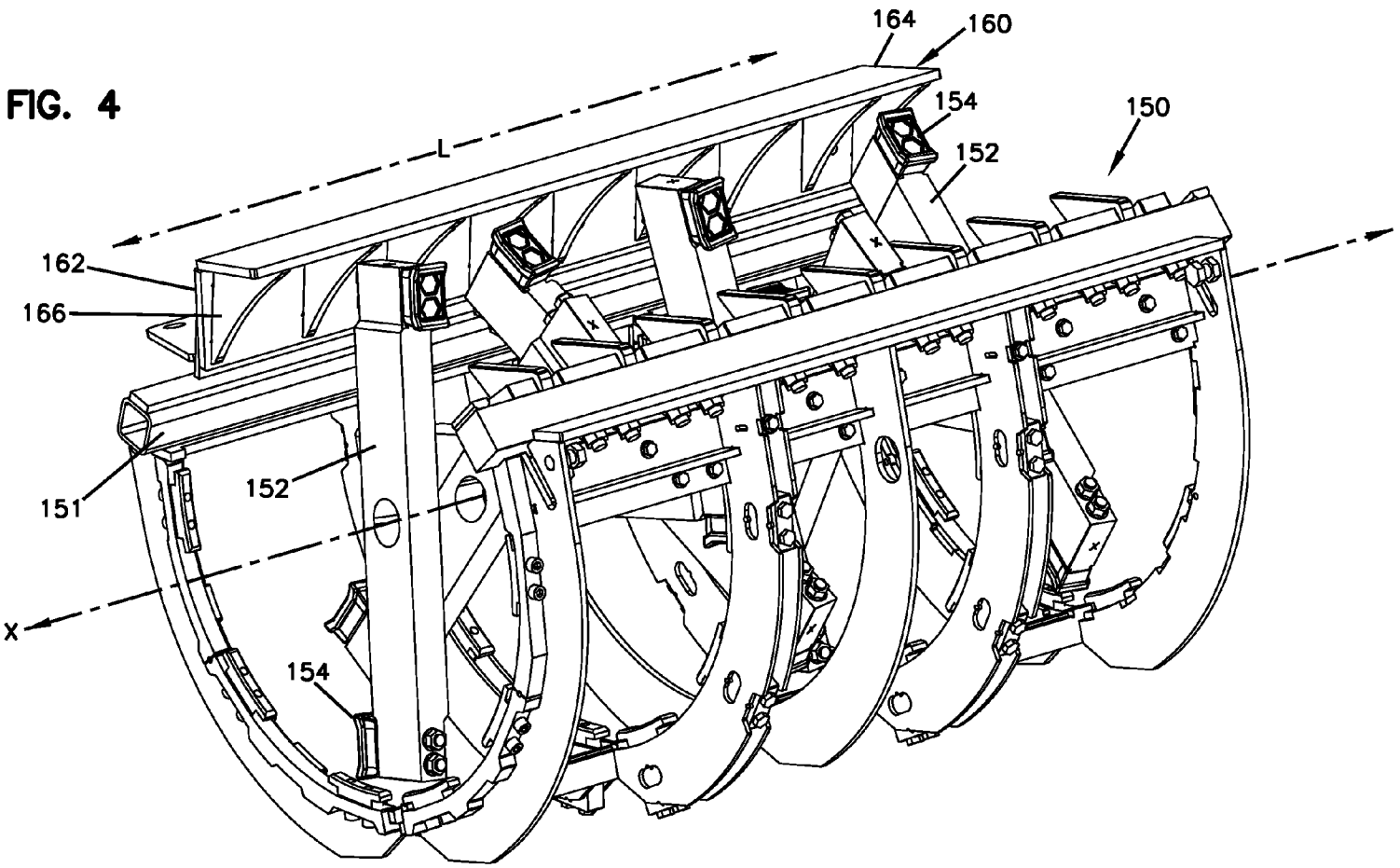
FIG. 4 is a perspective view of the grinder and deflection structure shown in FIG. 3.

In some implementations, one or more ribs or gussets 166 extend between the first deflection portion 162 and the second deflection portion 164. In the example shown in FIG. 4, multiple ribs 166 are spaced along a length L of the deflection structure 160. In general, the ribs 166 are located within the flow path of material being ejected from the grinder 150 towards the deflection structure 160. Each rib 166 includes a generally triangular plate having a first edge extending along the first deflection portion 162 and a second edge extending along the second deflection portion 164. A third edge of the triangle faces the grinder 150. In certain implementations, the third edge defines an arc or other curvature. In some implementations, the ribs 166 provide structural support for the second deflection portion 164.

In some implementations, the deflection structure 160 is positioned near the floor 114 above a portion 151 of the grinder 150. In the depicted embodiment, the portion 151 is a bar like or bar shaped portion. The deflection structure 160 is positioned outside the reducing boundary of the grinder 150. In some implementations, the deflection structure 160 extends over less than half of the reducing boundary of the grinder 150. In certain implementations, the deflection structure 160 extends over less than a quarter of the reducing boundary of the grinder 150. In certain implementations, the deflection structure 160 extends across less than half of a cross-dimension (e.g., a diameter) of the grinder 150. The deflection structure 160 is disposed so that the first deflecting portion 162 is positioned upstream from the second deflecting portion 164 along the material flow path of the grinder 150. The first deflection portion 162 is angled upwardly relative to the floor 114 so that material ejected by the grinder 150 may slide along the first deflector portion 162 towards the second deflector portion 164. In general, the first deflection portion 162 is oriented at an angle sufficient to release the material from the tub 120 if unchecked.

The momentum of the ejected material is interrupted upon striking the second deflection portion 164. In some implementations, the second deflection portion 164 is oriented horizontally. In other implementations, the second deflection portion 164 is oriented at a slight angle relative to the floor 114. Generally, the angle is no more than 20°. In some implementations, the angle is no more than 10°. In certain implementations, the angle is no more than 8°. In certain implementations, the angle is no more than 5°. In certain implementations, the angle is no more than 3°. In certain implementations, the angle is no more than 1°.

Figure 3:
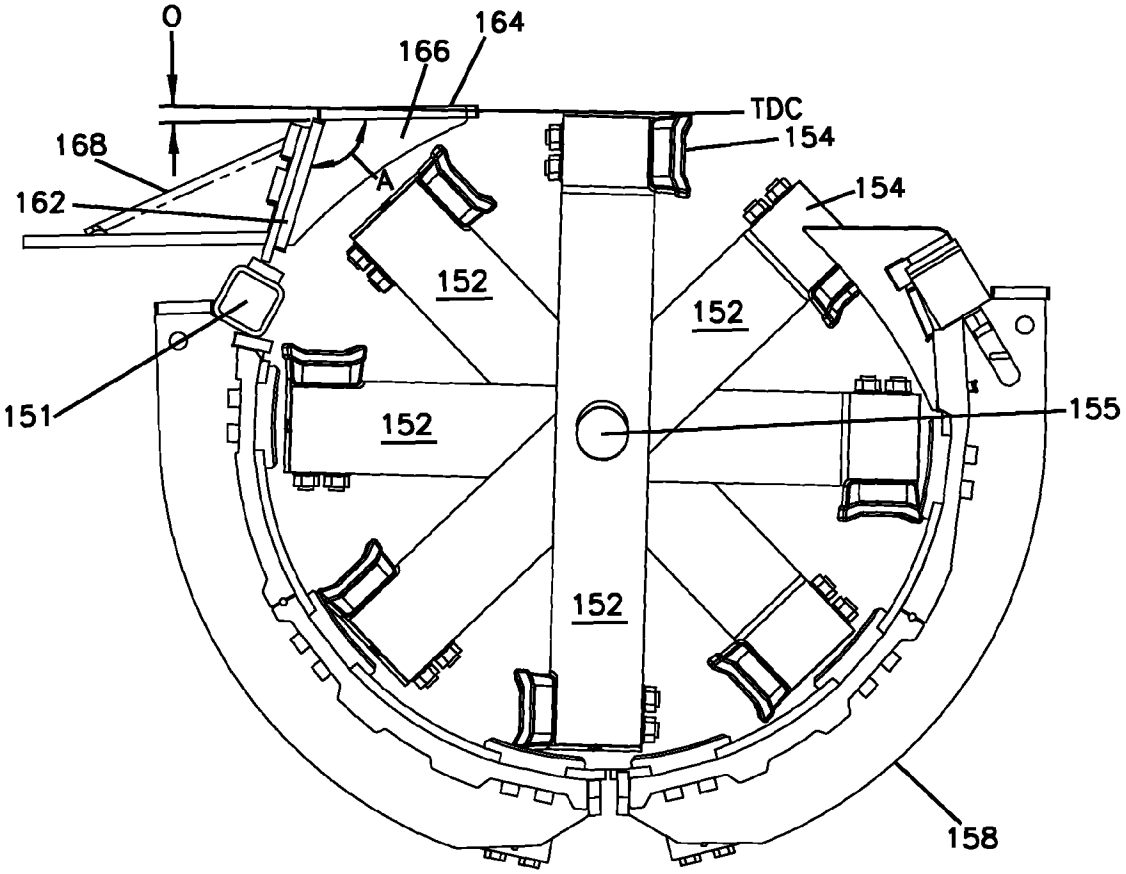
FIG. 3 is an enlarged view of the grinder and deflection structure shown in FIG. 2.

In some implementations, at least a portion of the second deflection portion 164 is positioned a distance from the floor 114 that is below the top dead center (TDC) of the grinder 150 (i.e., the zenith of the cutter 154 along the cutting path). For example, at least the first edge of the second deflection portion 164 shown in FIG. 3 is located a distance O below the TDC of the grinder 150. In certain implementations, the second edge of the second deflection portion 164 also is located below the TDC of the grinder 150. In other implementations, however, the second deflection portion 164 may be sufficiently angled so that the second edge is located at or above the TDC of the grinder 150. Some of the ejected material that strikes the second deflection portion 164 may fall back into the grinder 150 after striking the second deflection portion 164. Fallen material reengages the cutters 154, which may eject the material at a trajectory angled to hit the tub wall 122, 124. In some implementations, the trajectory of the material ejected past the deflection structure 160 has an angle Φ of no more than about 50°. In certain implementations, the angle Φ is no more than about 45°. In certain implementations, the angle Φ is no more than about 40°. In certain implementations, the angle Φ is no more than about 35°. In certain implementations, the angle Φ is no more than about 30°. In certain implementations, the angle Φ is no more than about 25°.

In certain examples, the first and second deflection portions are formed by one piece of material (e.g., one metal plate). In certain examples, the deflection structure has at least a portion positioned lower than top dead center of the cutting path of the grinder and the deflection structure is positioned over at least 35 percent of a top view area of the grinder. The top view area of the grinder equals the length of the grinder multiplied by the reducing diameter of the grinder. In certain examples, the deflection structure has at least a portion positioned lower than top dead center of the cutting path of the grinder and the deflection structure is positioned over 35-45 percent of the top view area of the grinder. In certain examples, the deflection structure has at least a portion that is positioned lower than top dead center of the cutting path of the grinder and is also positioned over at least 35 percent of the top view area of the grinder. In certain examples, the deflection structure has at least a portion that is positioned lower than top dead center of the cutting path of the grinder and is also is positioned over 35-45 percent of the top view area of the grinder. In certain examples, an entire deflecting surface of the deflection structure is no higher than top dead center of the cutting path of the grinder with the deflecting surface also positioned over at least 35 percent of the top view area of the grinder. In certain examples, the entire deflecting surface of the deflecting structure is positioned no higher than top dead center of the cutting path of the grinder with the deflecting surface also is positioned over 35-45 percent of the top view area of the grinder.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A tub grinder comprising:

a floor;

a tub positioned above the floor, the tub having a side wall, the tub being rotatable relative to the floor about a vertical axis;

a rotatable reducing unit mounted at an opening in the floor, the rotatable reducing unit having outermost portions that define a circular reducing boundary when the rotatable reducing unit is rotated in a reducing direction;

a screen positioned beneath the rotatable reducing unit; and a deflection structure positioned near the floor above the rotatable reducing unit, the deflection structure including first and second deflecting portions, the first deflecting portion being positioned upstream from the second deflecting portion, the first deflecting portion including a first and a second end, wherein the first end is positioned proximate to the floor and the second end is positioned proximate to the second deflecting portion, the first deflecting portion extending upwardly at an increasing distance and angling away from the circular reducing boundary from the first end to the second end, wherein the first end of the first deflecting portion is positioned in closer proximity to the reducing boundary than the second end of the first deflecting portion, the second deflecting portion extending away from the first deflecting portion in the reducing direction, the second deflecting portion angling towards the reducing boundary as the second deflecting portion extends in the reducing direction, wherein at least part of the second deflecting portion is located below a top, dead center of the reducing boundary of the grinder.

2. The tub grinder of claim 1, wherein the deflection structure releases ejected material at a trajectory having an angle of no more than 50 degrees.

3. The tub grinder of claim 1, wherein the deflection structure releases ejected material at a trajectory having an angle of no more than 35 degrees.

4. The tub grinder of claim 1, wherein the deflection structure releases ejected material at a trajectory having an angle of no more than 25 degrees.

5. The tub grinder of claim 1, wherein the first and second deflecting portions meet at a distinct angle transition.

6. The tub grinder of claim 1, wherein the second deflecting portion is closer to horizontal than the first deflecting portion.

7. The tub grinder of claim 6, wherein the second deflecting portion is angled to deflect material received from the first deflecting portion toward the circular reducing boundary.

8. The tub grinder of claim 1, wherein the first and second deflecting portions are formed of respective planar members.

9. The tub grinder of claim 8, wherein an angle greater than 90 degrees is defined between the first and second deflecting portions.

10. The tub grinder of claim 8, wherein the angle is in the range of 100 degrees and 120 degrees.

11. The tub grinder of claim 1, wherein the deflection structure includes a plurality of ribs extending between the first and second deflecting portions, and wherein the ribs are located within a flow path of material being reduced by the grinder.

12. The tub grinder of claim 1, wherein the first and second deflecting portions define a distinct angle therein between and the second deflecting portion is angled to extend toward the circular reducing boundary as the second deflecting portion extends along the reducing direction.

13. The tub grinder of claim 12, wherein the first deflecting portion is angled to extend away from the circular reducing boundary as the first deflecting portion extends along the reducing direction.

14. The tub grinder of claim 1, wherein the first and second deflecting portions are formed by planar members aligned at an angle relative to one another, and wherein the second deflecting portion is closer to horizontal than the first deflecting portion.

15. The tub grinder of claim 1, wherein the deflection structure covers at least 35 percent of a top view area of the grinder, the top view area of the grinder being equal to a length of the grinder multiplied by a diameter of the circular reducing boundary of the grinder.

16. The tub grinder of claim 15, wherein the deflection structure covers 35-45 percent of the top view area of the grinder.

17. The tub grinder of claim 15, wherein an entire deflection surface of the deflection structure is positioned no higher than the top, dead center of the reducing boundary of the grinder.

18. The tub grinder of claim 1, wherein the screen includes a plurality of through holes.

19. The tub grinder of claim 1, wherein the screen extends at least about 180 degrees around the circular reducing boundary of the rotatable reducing unit.

20. The tub grinder of claim 1, wherein the first deflecting portion is intersected by a reference plane positioned tangent to the circular reducing boundary at a downstream end of the screen.

21. The tub grinder of claim 1, further comprising a bar shaped portion positioned adjacent a downstream end of the screen.

22. The tub grinder of claim 21, wherein an end of the first deflecting portion is positioned adjacent the bar shaped portion.

23. The tub grinder of claim 1, wherein the second deflecting portion covers more of a top view area of the grinder than the first deflecting portion.

24. The tub grinder of claim 1, wherein at least another part of the second deflecting portion is located at the top, dead center of the reducing boundary of the grinder, wherein the second deflecting portion covers more of a top view area of the grinder than the first deflecting portion.

25. A tub grinder comprising:

a floor;

a tub positioned above the floor, the tub having a side wall, the tub being rotatable relative to the floor about a vertical axis;

a grinder mounted at an opening in the floor, the grinder having cutters that define a circular reducing boundary when the grinder is rotated in a reducing direction;

a screen positioned beneath the grinder; and a deflection structure positioned near the floor above the grinder, the deflection structure being positioned above a portion of the grinder outside the circular reducing boundary of the grinder, the deflection structure including first and second deflecting portions, the first deflecting portion including a first and a second end, wherein the first end is positioned proximate to the floor and the second end is positioned proximate to the second deflecting portion, the first deflecting portion extending upwardly at an increasing distance and angling away from the circular reducing boundary from the first end to the second end, wherein the first end of the first deflecting portion is positioned in closer proximity to the reducing boundary than the second end of the first deflecting portion, the second deflecting portion being oriented closer to horizontal than the first deflecting portion, wherein at least part of the second deflecting portion of the deflection structure is positioned below a top, center of the circular reducing boundary of the grinder, and wherein the trajectory of material ejected past the deflection structure has an angle of no more than 50 degrees.

26. The tub grinder of claim 25, wherein the deflection structure releases ejected material at a trajectory having an angle of no more than 45 degrees.

27. The tub grinder of claim 25, wherein the deflection structure releases ejected material at a trajectory having an angle of no more than 35 degrees.

28. The tub grinder of claim 25, wherein the deflection structure releases ejected material at a trajectory having an angle of no more than 25 degrees.

29. A tub grinder comprising:

a floor;

a tub positioned above the floor, the tub having a side wall, the tub being rotatable relative to the floor about a vertical axis;

a grinder mounted at an opening in the floor, the grinder having cutters that define a circular reducing boundary when the grinder is rotated in a reducing direction;

a screen positioned beneath the grinder; and a deflection structure positioned near the floor above the grinder, the deflection structure including first and second planar deflecting portions, the first deflecting portion including a first and a second end, wherein the first end is positioned proximate to the floor and the second end is positioned proximate to the second deflecting portion, the first deflecting portion extending upwardly at an increasing distance and angling away from the circular reducing boundary from the first end to the second end, wherein the first end of the first deflecting portion is positioned in closer proximity to the reducing boundary than the second end of the first deflecting portion, the second deflecting portion being oriented closer to horizontal than the first deflecting portion, wherein at least part of the second deflecting portion is located below a top, dead center of the reducing boundary of the grinder.

30. A comminuting apparatus comprising:

a bottom plate;

a tub disposed at the bottom plate and being rotatable relative to the bottom plate;

a comminuting drum that extends partially through the bottom plate, the comminuting drum being configured to rotate about a horizontal axis of rotation, the comminuting drum being configured to throw material in the tub along a material flow path; and a deflection structure that extends partially over the drum, the deflection structure defining an exit aperture through which material is thrown by the comminuting drum during operation, the deflection structure including a first planar member and a second planar member, the first planar member including a first and a second end, wherein the first end is positioned proximate to the floor and the second end is positioned proximate to the second planar member, the first planar member extending upwardly at an increasing distance and angling away from the circular reducing boundary from the first end to the second end, wherein the first end of the first planar member is positioned in closer proximity to a reducing boundary defined by the comminuting drum than the second end of the first planar member, the second planar member being oriented generally horizontal and the first planar member being angled relative to the second planar member, wherein at least part of the second planar member is located below a top, dead center of the reducing boundary of the comminuting drum, wherein material within the tub that strikes the first planar member and slides along the first planar member to the second planar member, at which the material changes direction and reduces speed.

31. A tub grinder comprising:

a floor;

a tub positioned above the floor, the tub having a side wall, the tub being rotatable relative to the floor about a vertical axis;

a grinder mounted at an opening in the floor, the grinder having cutters that define a circular reducing boundary when the grinder is rotated in a reducing direction;

a screen positioned beneath the grinder; and a deflection structure positioned near the floor above the grinder, the deflection structure being positioned above a portion of the grinder outside the circular reducing boundary of the grinder, the deflection structure including first and second deflecting portions, the first deflecting portion including a first and a second end, wherein the first end is positioned proximate to the floor and the second end is positioned proximate to the second deflecting portion, the first deflecting portion extending upwardly at an increasing distance and angling away from the circular reducing boundary from the first end to the second end, wherein the first end of the first deflecting portion is positioned in closer proximity to the reducing boundary than the second end of the first deflecting portion, the second deflecting portion being oriented closer to horizontal than the first deflecting portion, wherein at least part of the second deflecting portion of the deflection structure is positioned below a top, center of the circular reducing boundary of the grinder, and wherein the deflection structure covers at least 35 percent of a top view area of the grinder, the top view area of the grinder being equal to a length of the grinder multiplied by a diameter of the circular reducing boundary of the grinder.

* * * * *